US008956127B2

(12) United States Patent
Hirota

(10) Patent No.: US 8,956,127 B2
(45) Date of Patent: Feb. 17, 2015

(54) CONTROL VALVE FOR VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 462 days.

(21) Appl. No.: 13/344,591

(22) Filed: Jan. 5, 2012

(65) Prior Publication Data

US 2013/0001450 A1 Jan. 3, 2013

(30) Foreign Application Priority Data

Jan. 7, 2011 (JP) ..... 2011-001637

(51) Int. Cl.

| | |
|---|---|
| ***F04B 1/26*** | (2006.01) |
| ***F04B 1/32*** | (2006.01) |
| ***F04B 1/29*** | (2006.01) |
| ***F04B 49/22*** | (2006.01) |
| *F04B 27/18* | (2006.01) |

(52) U.S. Cl.

CPC ..... *F04B 1/324* (2013.01); *F04B 1/295* (2013.01); *F04B 49/22* (2013.01); *F04B 2027/1813* (2013.01); *F04B 2027/1827* (2013.01); *F04B 2027/1831* (2013.01); *F04B 2027/1854* (2013.01); *F04B 2027/1859* (2013.01)

USPC ..... 417/222.1; 417/270

(58) Field of Classification Search

CPC ..... F04B 49/22

USPC ..... 417/222.1, 222.2; 251/129.15; 62/228.3; 335/255, 261; 137/102, 137/625.65

See application file for complete search history.

(56) References Cited

U.S. PATENT DOCUMENTS

| | | | | |
|---|---|---|---|---|
| 6,439,858 | B1 * | 8/2002 | Kume et al. | 417/222.2 |
| 2005/0201866 | A1 * | 9/2005 | Hirota | 417/222.2 |
| 2006/0039799 | A1 * | 2/2006 | Hirota | 417/222.2 |

FOREIGN PATENT DOCUMENTS

| | | | | |
|---|---|---|---|---|
| EP | 0945617 | A2 | 9/1999 | |
| EP | 1998044 | A2 | 12/2008 | |
| FR | 2836521 | A1 | 8/2003 | |
| JP | 2008-045526 | | 2/2008 | F04B 27/14 |
| KR | 20100107178 | A | 10/2010 | |
| KR | 20100107178 | KR | 10/2010 | |

OTHER PUBLICATIONS

European Search Report from application No. 12150307.2-1608/2474737 dated Nov. 14, 2014 (6 pages).

* cited by examiner

*Primary Examiner* — Charles Freay
*Assistant Examiner* — Nathan Zollinger
(74) *Attorney, Agent, or Firm* — Martine Penilla Group, LLP

(57) ABSTRACT

A control valve includes a body having a crankcase communicating port, a discharge chamber communicating port and a suction chamber communicating port, which are arranged in this order from one end side of the body, a solenoid, provided at the other end side of the body, for driving a main valve in accordance with the amount of current supplied, a power element, provided in an inner space surrounded by the body and the solenoid, capable of exerting the drive force to resist the solenoidal force created by a displacement of a pressure-sensing member of the power element, and a shaft by which the drive force of the power element is adjustable by adjusting the fixed position of one end side of the shaft, the shaft being fixed to one end of the body and the other end of the shaft being joined with the power element.

9 Claims, 13 Drawing Sheets

CONTROL VALVE FOR VARIABLE DISPLACEMENT COMPRESSOR

CLAIM OF PRIORITY TO RELATED APPLICATION

The present application is claiming priority of Japanese Patent Application No. 2011-001637, filed on Jan. 7, 2011, the content of which is incorporated herein by reference.

BACKGROUND OF THE INVENTION

1. Field of the Invention

The present invention relates to a control valve that is suitable for controlling the discharging capacity of a variable displacement compressor for an automotive air conditioner.

2. Description of the Related Art

An automotive air conditioner generally includes a compressor, a condenser, an expander, an evaporator, and so forth. Here, the compressor discharges a high-temperature and high-pressure gas refrigerant produced by compressing a refrigerant flowing through a refrigeration cycle of a vehicle. The condenser condenses the gas refrigerant. The expander produces a low-temperature and low-pressure refrigerant by adiabatically expanding the condensed liquid refrigerant. The evaporator evaporates the refrigerant and thereby causes a heat exchange of the refrigerant with the air inside the vehicle. The refrigerant evaporated by the evaporator is again brought back to the compressor and thus circulates through the refrigeration cycle.

The compressor is, for example, a variable displacement compressor (hereinafter referred to simply as "compressor" also) capable of controlling the refrigerant discharging capacity in order to maintain a constant level of cooling capacity irrespective of the engine speed. This compressor has a piston for compression linked to a wobble plate that is mounted to a rotational shaft driven by an engine, and the compressor controls the refrigerant discharge rate by changing the stroke of the piston through changes in the angle of the wobble plate. The angle of the wobble plate can be changed continuously by changing the balance of pressure working on both faces of the piston as part of the discharged refrigerant is introduced into an airtight crankcase. The pressure within this crankcase (hereinafter referred to as "crank pressure") Pc is controlled by a control valve for a variable displacement compressor (hereinafter referred to simply as "control valve" also), which is provided between the discharge chamber of the compressor and the crankcase or between the crankcase and the suction chamber thereof.

One of these control valves, such as one disclosed in Reference (1) in the following Related Art List, controls the crank pressure Pc through control of the amount of refrigerant introduced into the crankcase in accordance with a suction pressure Ps. This control valve includes a pressure-sensing section to develop a displacement by sensing the suction pressure Ps, a valve section for opening and closing the passage from the discharge chamber to the crankcase in response to a drive force from the pressure-sensing section, and a solenoid capable of changing the setting of the drive force from the pressure-sensing section by external electric current. The control valve like this opens and closes the valve section in such a manner as to maintain the suction pressure Ps at a pressure set by the external electric current. Generally, the suction pressure Ps is proportional to a refrigerant temperature at the exit of the evaporator, and thus the freezing or the like of the evaporator can be prevented by maintaining the pressure setting at or above a predetermined value. Also, when the engine load of a vehicle is high, the compressor can be operated at the minimum capacity by fully opening the valve section with the solenoid turned off and by setting the wobble plate substantially at a right angle to the rotational shaft with the crank pressure Pc set high.

RELATED ART LIST (1) Japanese Unexamined Patent Application Publication (Kokai) No. 2008-45526

It is to be noted that the pressure-sensing section of a control valve like this generally forms a reference pressure chamber surrounded by a pressure-sensing member such as a diaphragm or a bellows. And the pressure-sensing section of the control valve is provided with a spring disposed in the reference pressure chamber. Here, this spring exerts a load in such a direction that the pressure-sensing member extends. The drive force against a solenoidal force is created by the displacement of the pressure-sensing member that is caused by a pressure difference between the inside and the outside of the reference pressure chamber. The drive force against the solenoidal force is adjusted by the load setting for the spring of the pressure-sensing section. The load setting is normally accomplished through positional adjustments of the pressure-sensing section and its adjacent members assembled in the direction of axis line at a manufacturing stage of the control valve.

However, it is desirable that fine adjustment can be made to the suction pressure Ps after the control valve is installed if the suction pressure Ps is to be set with high accuracy. In this regard, a type having the pressure-sensing section disposed at one end of the control valve body allows such fine adjustment by physically deforming a part of the pressure-sensing section after installation in the direction of the axis line. However, it is difficult to accomplish such fine adjustment with the type having the pressure-sensing section disposed inside the control valve body such as one disclosed in Reference (1).

SUMMARY OF THE INVENTION

The present invention has been made in view of the foregoing problems, and a purpose thereof is to provide a technology that enables easy external adjustment of the setting of the drive force of a pressure-sensing section in a control valve for a variable displacement compressor, which is a so-called Ps sensing type having the pressure-sensing section inside the control valve body.

In order to resolve the aforementioned problems, a control valve, for a variable displacement compressor, according to one embodiment of present invention is a control vale for the variable displacement compressor for varying a discharging capacity of the variable displacement compressor by controlling a flow rate of refrigerant to be introduced from a discharge chamber to a crankcase of the compressor in such a manner that a suction pressure of a suction chamber is kept at a pressure setting, and the control valve includes: a body having a crankcase communicating port that communicates with the crankcase from one end side thereof, a discharge chamber communicating port that communicates with the discharge chamber, and a suction chamber communicating port that communicates with the suction chamber, wherein the crankcase communicating port, the discharge chamber communicating port, and the suction chamber communicating port are arranged in this order from one end side of the body; a main valve element configured to open and close a main valve provided in a refrigerant passage communicating between the discharge chamber communicating port and the crankcase communicating port; a solenoid, provided at the other end side of the body, configured to drive the main valve element in a valve closing direction in accordance with an amount of current supplied; a pressure-sensing section including a pressure-sensing member displaced by sensing the suction pressure, wherein the pressure sensing section is provided inside an inner space surrounded by the body and the solenoid, and the pressure sensing section exerts a drive force against solenoidal force caused by a displacement of the pressure-sensing member; and a shaft configured to adjust the drive force of the pressure-sensing section by adjusting a fixed position at one end of the shaft, the shaft extending from one end side thereof to the other side thereof along an axis line, one end of the shaft being fixed to the one end side of the body and the other end of the shaft being joined with the pressure-sensing section.

By employing this embodiment, provided is the shaft extending along the direction of axis line from one end of the body toward the other end thereof, so that the fine adjustment of the drive force by the pressure-sensing section can be easily accomplished when the fixed position of the shaft is readjusted after the control valve has been assembled. Note that shaft may be fixed to the body using a press-fitting process. In such a case, the load setting of the pressure-sensing section can be fine-adjusted by adjusting a press-fitting amount thereof. Or the shaft itself may have a screw structure. In such a case, the load setting of the pressure-sensing section can be fine-adjusted by a screwing amount of the shaft.

BRIEF DESCRIPTION OF THE DRAWINGS

Embodiments will now be described by way of examples only, with reference to the accompanying drawings which are meant to be exemplary, not limiting, and wherein like elements are numbered alike in several Figures in which.

DETAILED DESCRIPTION OF THE INVENTION

The present invention will now be described in detail based on preferred embodiments with reference to the accompanying drawings. This does not intend to limit the scope of the present invention, but to exemplify the invention.

In the following description, for convenience of description, the positional relationship in each structure may be expressed as "vertical" or "up-down" with reference to how each structure is depicted in Figures.

First Embodiment

Figure 1:
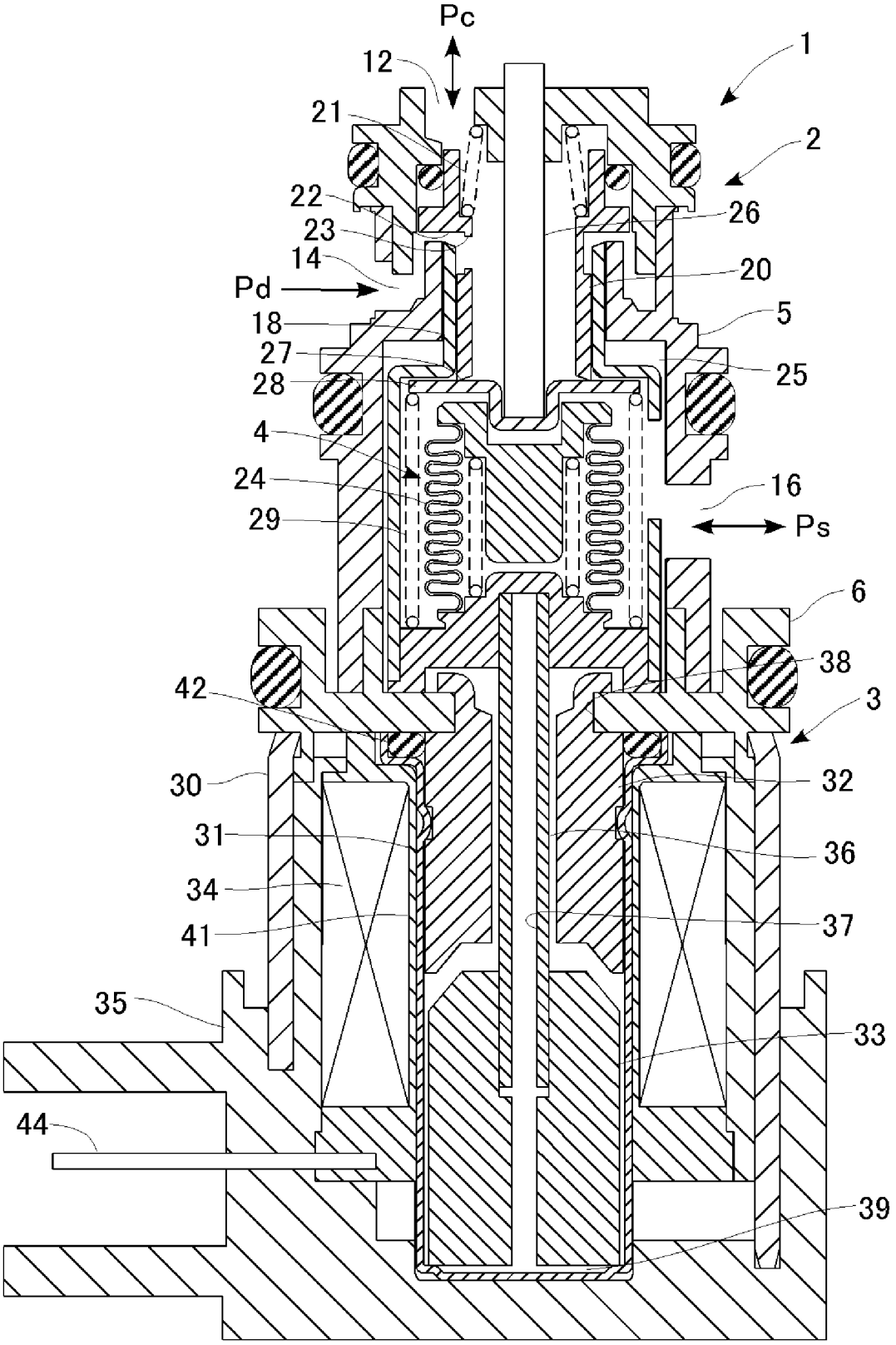
FIG. 1 is a cross-sectional view of a structure of a control valve according to a first embodiment of the present invention.

FIG. 1 is a cross-sectional view of a structure of a control valve according to a first embodiment of the present invention.

The control valve 1 according to this embodiment is constituted as a control valve (electromagnetic valve) for controlling a not-shown variable displacement compressor (hereinafter referred to simply as "compressor") to be installed for a refrigeration cycle of an automotive air conditioner. This compressor discharges a high-temperature and high-pressure gas refrigerant produced by compressing a refrigerant flowing through the refrigeration cycle. The gas refrigerant is then condensed by a condenser (external heat-exchanger) and further adiabatically expanded by an expander so as to become a misty, low-temperature and low-pressure refrigerant. This low-temperature and low-pressure refrigerant is evaporated by an evaporator, and the evaporative latent heat cools the air of an interior of a vehicle. The refrigerant evaporated by the evaporator is again brought back to the compressor and thus circulates through the refrigeration cycle. This compressor has a piston for compression coupled to a wobble plate which is mounted to a rotational shaft driven by an engine of the vehicle, and the compressor controls the refrigerant discharge rate by changing a stroke of the piston through changes in an angle of the wobble plate. The control valve 1 changes the angle of the wobble plate and further the discharging capacity of the compressor by controlling a flow rate of the refrigerant to be introduced from a discharge chamber to a crankcase of the compressor.

The control valve 1 is constituted as a so-called Ps sensing valve that controls the flow rate of the refrigerant to be introduced from the discharge chamber to the crankcase so that a suction pressure Ps of the compressor can be maintained at a pressure setting. The control valve 1 is constituted by integrally assembling a valve unit 2, which includes a valve section for opening and closing a refrigerant passage for leading part of discharged refrigerant to the crankcase, and a solenoid 3, which controls the flow rate of the refrigerant to be led into the crankcase by controlling the opening degree of the valve section. The valve unit 2 includes a body 5 of stepped cylindrical shape, a valve section disposed inside the body 5, and a power element ("pressure-sensing section") 4, disposed inside the body 5, which generates drive force to open and close the valve section. The body 5 and the solenoid 3 are joined together by a connecting member 6.

The body 5 has a port 12 ("crankcase communicating port"), a port 14 ("discharge chamber communicating port"), and a port 16 ("suction chamber communicating port") in this order from top down. Formed within the body 5 are a first refrigerant passage communicating between the port 12 and the port 14 and a second refrigerant passage communicating between the port 12 and the port 16. Whereas a main valve is provided on the first refrigerant passage to open or close it, a sub-valve is provided on the second refrigerant passage to open or close it.

The port 14 communicates with the discharge chamber of the compressor, thereby introducing the refrigerant at a discharge pressure Pd. The port 12 communicates with the crankcase of the compressor, thereby leading out the refrigerant at the crank pressure Pc having passed the main valve toward the crankcase and, on the other hand, leading in the refrigerant at the crank pressure Pc discharged from the crankcase at the time of compressor startup. The refrigerant thus led in is led to the sub-valve. The port 16 communicates with the suction chamber of the compressor, thereby leading in the refrigerant at the suction pressure Ps and, on the other hand, leading out the refrigerant at the suction pressure Ps via the sub-valve toward the suction chamber at the time of compressor startup.

The body 5 has a main valve element 18 and a sub-valve element 20 disposed coaxially. The main valve element 18, which is of a stepped cylindrical shape with reduced diameter in an upper portion, is slidably supported by the body 5 in the upper portion. The sub-valve element 20 is cylindrical in shape, and a lower half thereof is slidably inserted in the reduced diameter portion of the main valve element 18. A flange portion extending radially outward is provided in an upper part of the sub-valve element 20, and a main valve seat 22 is formed on a lower surface of the flange portion. A communicating hole 23 communicating the inside and the outside of the sub-valve element 20 is provided in a side wall inside of the main valve seat 22 of the sub-valve element 20. The main valve is opened and closed with the top end of the main valve element 18 touching and leaving the main valve seat 22, thereby adjusting the flow rate of refrigerant flowing from the discharge chamber to the crankcase. The sub-valve element 20 communicates with the port 12 at an upper end opening, and the inside passage forms a first refrigerant passage at the opening of the main valve and forms a second refrigerant passage at the opening of the sub-valve.

The power element 4 is disposed inside a pressure chamber 25 (inner space) which is surrounded by the lower half of the body 5 and the solenoid 3. The power element 4 contains a bellows 24 that expands or contracts by sensing the suction pressure Ps. And the bellows 24, with its displacement, exerts a drive force against solenoidal force to the main valve element 18. The main valve element 18 is joined with the power element 4 in such a manner as to be able to move together. A detailed description of the power element 4 will be given later.

Provided in an upper half of the body 5 is a shaft 26 extending along the axis line thereof. The shaft 26 is secured with one end thereof press-fitted into an upper end of the body 5 and the other end thereof connected to the power element 4 via a valve seat forming member 28. The valve seat forming member 28 is disk-shaped and has a sub-valve seat 27 formed on the face thereof opposite to a lower end opening of the sub-valve element 20. The sub-valve is opened and closed with the sub-valve element 20 touching and leaving the sub-valve seat 27, thereby adjusting the flow rate of refrigerant being relieved from the crankcase to the suction chamber. Set between the valve seat forming member 28 and the power element 4 is a spring 29 (functioning as a "biasing member") that biases the main valve element 18 in a valve opening direction. Set between the sub-valve element 20 and the body 5 is a spring 21 that biases the sub-valve element 20 in a valve closing direction of the sub valve.

On the other hand, the solenoid 3 includes a cylindrical case 30, which functions as a yoke also, a sleeve 31, which is a bottomed cylinder fixed to the case 30, a cylindrical core 32, which is inserted in an upper half of the sleeve 31, a cylindrical plunger 33, which is housed in a lower half of the sleeve 31 in a position axially opposite to the core 32, an electromagnetic coil 34, which generates a magnetic circuit by externally supplied current, and an end member 35, which is provided to seal a lower end opening of the case 30. An insertion hole 38 is so formed as to penetrate the central part of the connecting member 6. And the core 32 is secured to the connecting member 6 in such a manner that an upper end part of the core 32 is swaged outward after passing through the insertion hole 38.

A cylindrical transmitting rod 36 is inserted in such a manner as to penetrate axially the center of the core 32. A lower end of the transmitting rod 36 is press-fitted coaxially in an upper end of the plunger 33. As a result, the transmitting rod 36 and the plunger 33 are fixed to each other, and an inner passage 37 is so formed as to penetrate both the aforementioned parts in the direction of axis line. An upper end of the transmitting rod 36 is joined with the power element 4, so that the transmitting rod 36 transmits the solenoidal force to the main valve element 18 by way of the power element 4.

The suction pressure Ps in the pressure chamber 25, on one hand, is led into the inner passage 37 through the clearance between the transmitting rod 36 and the power element 4 and then into a back pressure chamber 39 of the plunger 33 after passing through the inner passage 37. The suction pressure Ps in the pressure chamber 25, on the other hand, is led into the sleeve 31 through the clearance between the core 32 and the transmitting rod 36.

The sleeve 31, which is made of a nonmagnetic material, has a slightly protruding bottom center portion, as shown in FIG. 1, such that the back pressure chamber 39 can be formed when the plunger 33 is positioned at a bottom dead point. Also, a cylindrical bobbin 41 is fitted around the sleeve 31, and an electromagnetic coil 34 is wound around the bobbin 41. A seal ring 42 is set in the space surrounded by the outer periphery of an upper end of the core 32, an upper end surface of the sleeve 31, and a bottom inner surface of the connecting member 6 such that a seal of the interior of the solenoid 3 against the exterior is maintained. A pair of connection terminals 44 connected to the electromagnetic coil 34 extend from the bobbin 41 and are led outside by passing through the end member 35. Note that only one of the pair is shown in FIG. 1 for convenience of explanation.

The end member 35 is installed in such a manner as to seal the entire structure inside the solenoid 3 contained in the case 30 from below. The end member 35 is molded (injection molding) of a corrosion-resistant resin, and the resin material is filled into gaps between the case 30 and the electromagnetic coil 34 also. With the resin material filled into the gaps between the case 30 and the electromagnetic coil 34, the heat release performance is improved because the heat occurring in the electromagnetic coil 34 can be easily conveyed to the case 30. The ends of the connection terminals 44 are led out from the end member 35 and connected to a not-shown external power supply.

Figure 2:
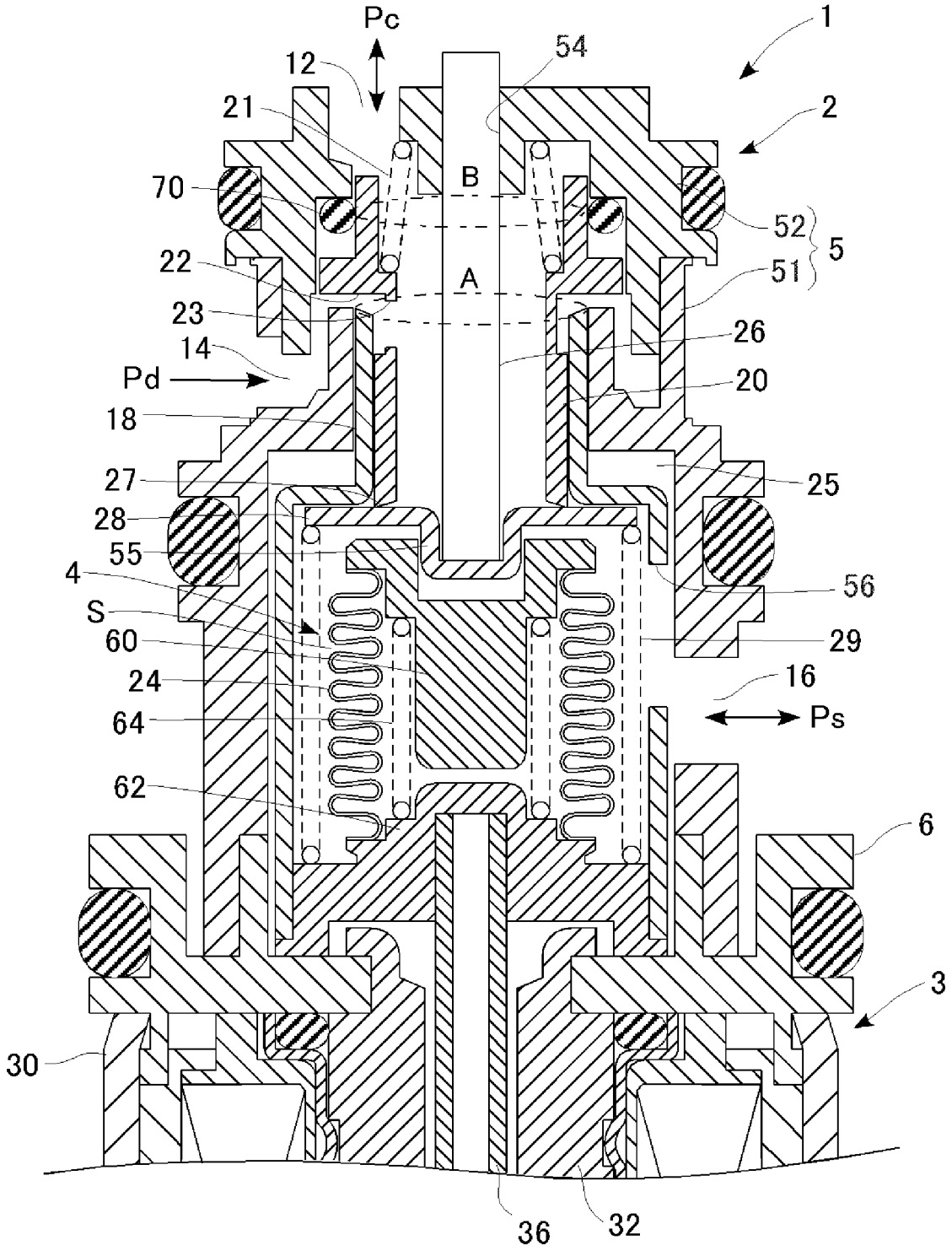
FIG. 2 is a partially enlarged sectional view of an upper half of FIG. 1.

FIG. 2 is a partially enlarged sectional view of the upper half of FIG. 1.

The body 5 is constituted as an assembly of a first body 51 of a stepped cylindrical shape and a second body 52 of a bottomed cylindrical shape fitted on an upper end opening of the first body 51. With a lower half of the second body 52 press-fitted into an upper end portion of the first body 51, the assembly as a whole forms a bottomed and stepped cylindrical body 5. The port 12 is provided in the bottom of the second body 52. The insertion hole 54 is provided in the center of the bottom of the second body 52, where the shaft 26 is press-fitted. The shaft 26, which is locked to a bottom center of the second body 52, is supported by one end thereof and extends downward along the axis line.

The valve seat forming member 28 has a fitting section 55 protruding downward in a middle portion thereof, and the fitting section 55 assures the centering of the valve seat forming member 28 positioned at a lower end of the shaft 26 fitted thereinto. Since the fitting state is maintained by the biasing force of the spring 29, the valve seat forming member 28 is supported by the shaft 26.

The main valve element 18 has a larger diameter body part thereof disposed in the pressure chamber 25. Disposed inside the larger diameter part are the valve seat, forming member 28, the power element 4, and the spring 29. The upper part of the main valve element 18, which is of a smaller diameter, is slidably supported by the upper part of the first body 51, and the main valve is opened and closed with the end portion of the main valve element 18 touching and leaving the main valve seat. Provided in a position corresponding to the port 16 of the main valve element 18 is a communicating hole 56 communicating the inside and the outside of the main valve element 18.

Fitted on the outer periphery of the upper end portion of the sub-valve element 20 is an O-ring 70 for sealing. This prevents the high-pressure refrigerant introduced through the port 14 from leaking into the port 12 by passing through the gap passage between the sub-valve element 20 and the second body 52.

The power element 4 is so structured that the upper end opening of the bellows 24 is closed by a first stopper 60 ("base member") and the lower end opening of the bellows 24 is closed by a second stopper 62 ("base member"). The interior of the bellows 24 is an airtight reference pressure chamber S, and a spring 64 is interposed between the first stopper 60 and the second stopper 62 in such a manner as to bias the bellows 24 in an expanding direction. The reference pressure chamber S is in a vacuum state according to the present embodiment. Provided in the middle of a top surface of the first stopper 60 is a circular recess of a predetermined depth along the direction of axis line, where the fitting section 55 of the valve seat forming member 28 is joined in a fitted manner. Also provided in the middle of a lower surface of the second stopper 62 is a circular recess of a predetermined depth along the direction of axis line, where the upper end portion of the transmitting rod 36 is joined in a fitted manner. The main valve element 18 is secured such that the lower end portion of the main valve element 18 is press-fitted on the second stopper 62.

Since the spring 64 exerts a biasing force in such a manner as to move the first stopper 60 and the second stopper 62 apart from each other, the bellows 24 expands or contracts in the direction of axis line (opening/closing direction of the valve section) according to a pressure difference between the suction pressure Ps of the pressure chamber 25 and the reference pressure of the reference pressure chamber S. However, if the pressure difference becomes large, the end surfaces of the first stopper 60 and the second stopper 62 will abut against each other at a predetermined contraction of the bellows 24, thus restricting the contraction.

In this arrangement, if the suction pressure Ps in the pressure chamber 25 drops lower than a predetermined pressure setting Pset, the bellows 24 will be deformed in an expanding direction, and the first stopper 60 will be stopped by the valve seat forming member 28. As a result, there will be a force to press down the second stopper 62, which is a force working to reduce the solenoidal force of the solenoid 3. This pressure setting Pset is basically adjusted in advance by the spring load of the spring 64. And this pressure setting Pset is set as a pressure value at which the freezing of the evaporator can be prevented in view of the relationship between the temperature in the evaporator and the suction pressure Ps. The pressure setting Pset can be changed by varying the supply current (set current) to the solenoid 3. In the present embodiment, the load setting of the spring 64 can be fine-adjusted by readjusting a press-fitting amount of the shaft 26 when the assembly of the control valve 1 is nearly completed. By employing this method, the pressure setting Pset can be adjusted with accuracy.

According to the present embodiment, the sub-valve element 20 is so formed that an upper sliding portion of the sub-valve element 20 has an outside diameter B (which is equal to an inside diameter of O-ring 70) which is smaller, by a predetermined amount, than an effective pressure-receiving diameter A of the main valve element 18. Hence, the pressure difference (Pd−Pc) between the discharge pressure Pd and the crank pressure Pc works downward on the sub-valve element 20. Therefore, even when the discharge pressure Pd led in through the port 14 rises high and thus the pressure difference (Pd−Pc) becomes large in a closed state of the main valve with the main valve element 18 touching the main valve seat 22, a circumstance can be prevented in which the main valve is opened with the sub-valve element 20 compressing the spring 21. On the other hand, when the main valve is opened, the travel of the sub-valve element 20 will be stopped by the valve seat forming member 28. Accordingly, a situation in which the opening of the main valve is blocked by the follow-up motion of the sub-valve element 20 after the main valve element 18 can be avoided, too. When the compressor is under control, the state of the sub-valve element 20 touching the sub-valve seat 27 under the effect of the biasing force of the spring 21 (sub-valve being closed) will be maintained.

Figure 3:
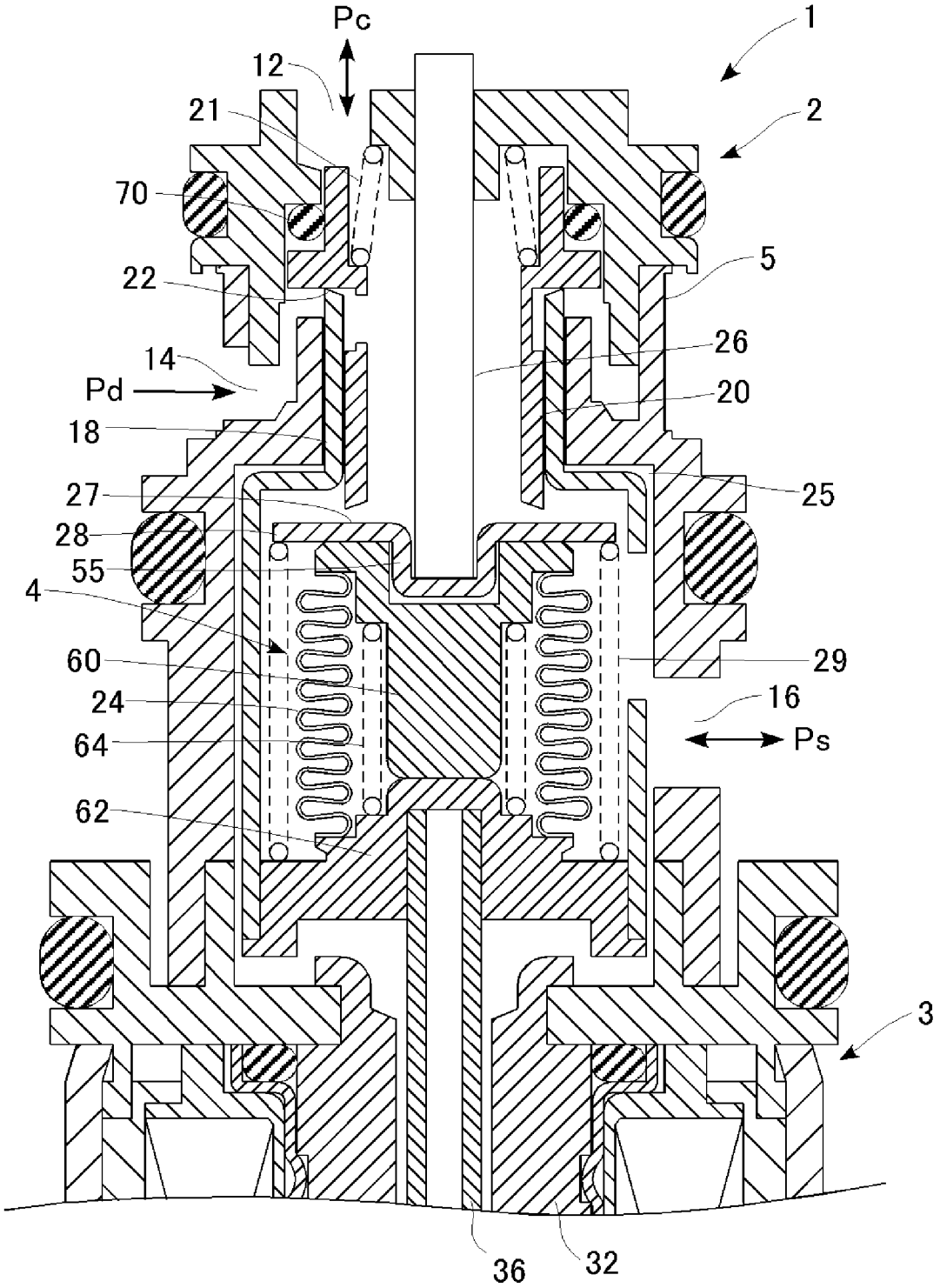
FIG. 3 is a diagram to explain an operation of a control valve.
Figure 4:
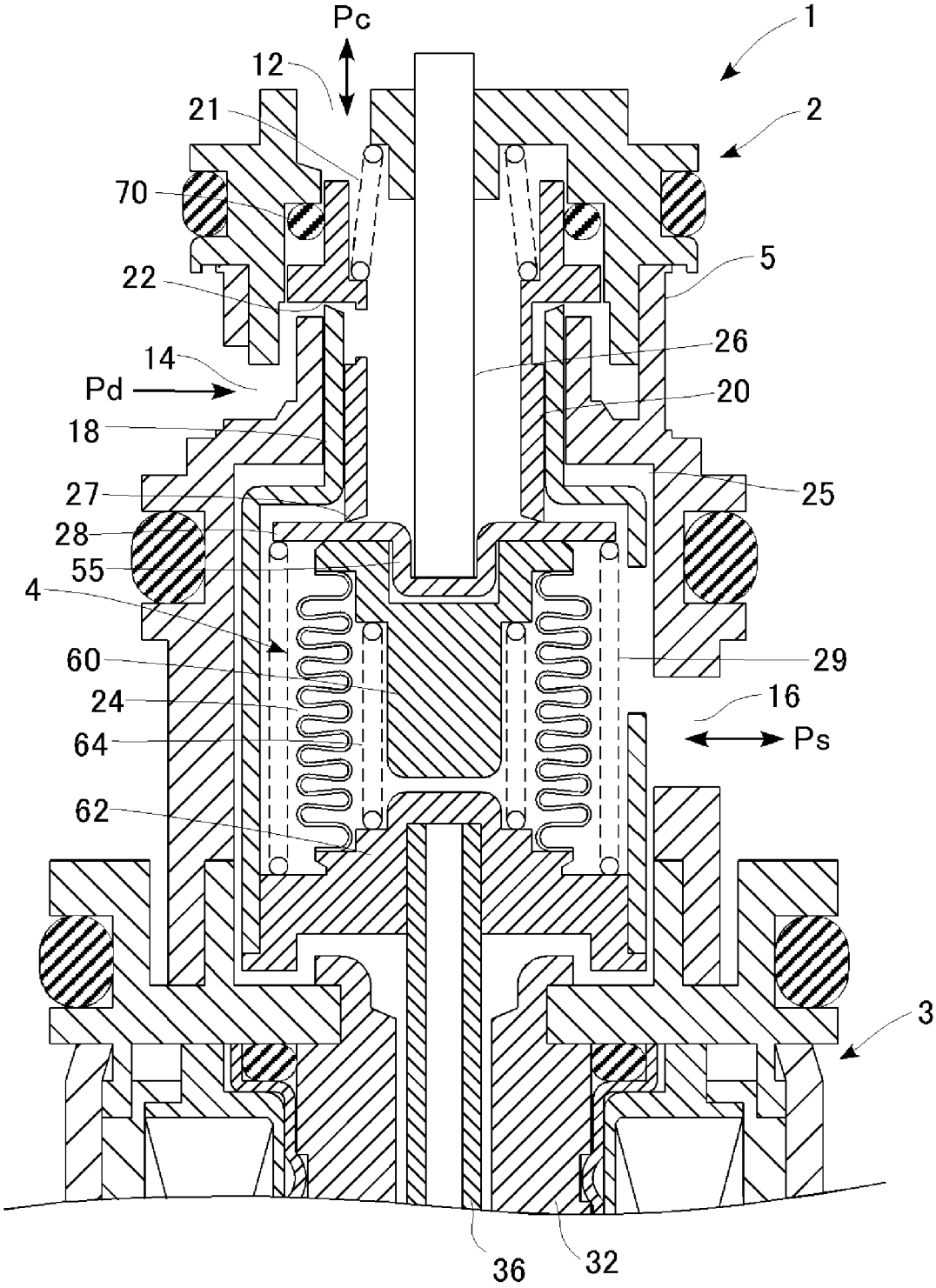
FIG. 4 is a diagram to explain an operation of a control valve.

Now, an operation of the control valve will be explained. FIG. 3 and FIG. 4 are each a diagram to explain an operation of the control valve, and FIG. 3 and FIG. 4 correspond to FIG. 2. FIG. 2, already described above, shows a state where the control valve operates with the minimum capacity. FIG. 4 shows a relatively stable control state. A description is given hereinbelow based on FIG. 1 with reference to FIG. 2 to FIG. 4, as appropriate.

While the solenoid 3 is not electrically conducting, namely while the automotive air conditioner is not operating, no suction power between the core 32 and the plunger 33 is in effect in the control valve 1. Also, since the spring 29 biases the second stopper 62 downward, the main valve element 18 is apart from the main valve seat 22 and therefore the main valve is fully opened, as shown in FIG. 2. At the same time, since the state of the sub-valve element 20 touching the sub-valve seat 27 under the effect of the biasing force of the spring 21 is maintained, the sub-valve is closed. That the valve seat forming member 28 is joined with the shaft 26 by the biasing force of the spring 29 contributes also to the fact that the closing state of the sub-valve is maintained.

At this time, the refrigerant, having the discharge pressure of Pd, which is introduced from the discharge chamber of the compressor passes through the fully opened main valve and flows into the crankcase from the port 12. Thus, the crank pressure Pc rises and then the compressor performs the minimum capacity operation. Since, at this time, the first stopper 60 is apart from the valve seat forming member 28 (i.e., the state in which any operation linkage is canceled), the power element 4 is substantially disabled.

On the other hand, when a maximum control current is supplied to the coil 34 of the solenoid 3 at the startup or the like of the automotive air conditioner, the plunger 33 is attracted by a maximum suction force of the core 32. Then, as shown in FIG. 3, the solenoidal force is directly conveyed to the main valve element 18 by way of the power element 4 (more precisely, the second stopper 62). As a result, the main valve element 18 touches the main valve seat 22. However, since the solenoidal force is large, not only the main valve is closed but also the main valve element 18 continues to rise up while the main valve element 18 presses the sub-valve element 20. As a result, the sub-valve element 20 gets separated away from the sub-valve seat 27 and the sub-valve is opened. At this time, the bellows 24 contracts to a minimum state where the first stopper 60 and the second stopper 62 are abutted against each other.

In other words, supplying the starting current to the solenoid 3 causes the main valve to be closed and thereby restricts the introduction of discharged refrigerant into the crankcase. At the same time, supplying the starting current thereto displaces the main valve element 18 and immediately opens the sub-valve so as to promptly relieve the refrigerant in the crankcase into the suction chamber. In the present embodiment, although the pressure of the crankcase is reduced via a decompression passage (e.g., an orifice joining the crankcase to the suction chamber) formed in the compressor, the decompression responsiveness can be maximally enhanced by quickly opening the sub-valve in this manner and therefore the compressor can be promptly started.

Here, in a controlled state where the value of current supplied to the solenoid 3 is set to a predetermined value, the main valve element 18 operates as an element different from the sub-valve element 20 and adjusts the opening degree of the main valve, as shown in FIG. 4, with the sub-valve element 20 seated on the sub-valve seat 27 and thereby the sub-valve being closed. In this case, the main valve element 18 stops at a valve-lift position where the force by the spring 29 in the valve opening direction, the solenoidal force by the solenoid 3 in the valve closing direction, and the repulsive force, with which to reduce the solenoidal force, by the power element 4 operated by the suction pressure Ps are all balanced thereamong.

As, for example, the refrigeration load becomes large and the suction pressure Ps becomes higher than the pressure setting Pset, the bellows 24 contracts with the result that the second stopper 62 and eventually the main valve element 18 are displaced relatively upward (in the valve closing direction). As a result, the valve opening degree of the main valve becomes small and therefore the compressor operates in a such manner as to increase the discharging capacity. As a result, a change is made in a direction that the suction pressure Ps drops. Conversely, as the refrigeration load becomes small and the suction pressure Ps becomes lower than the pressure setting Pset, the bellows 24 expands. As a result, the biasing force by the power element 4 works in such a direction as to decrease the solenoidal force. As a result, the force toward the main valve element 18 in the valve closing direction is reduced and the valve opening degree of the main valve becomes large. Thus, the compressor operates in such a manner as to reduce the discharging capacity. As a result, the suction pressure Ps is maintained at the pressure setting Pset, thereby preventing excess cooling.

In the control valve 1 as described above, provided is the shaft 26 extending along the direction of axis line from one end of the body 5 toward the other end thereof, and thereby the fixed position of the shaft 26 is readjusted after the control valve 1 has been assembled. Hence, the fine adjustment of the drive force by the power element 4 can be accomplished with ease. That is, the pressure setting Pset of the suction pressure Ps can be accurately adjusted using a simple structure.

Also, in the control valve 1, the transmitting rod 36 and the main valve element 18 are rigidly joined together by way of the second stopper 62 without the medium of an elastic member or the like disposed therebetween, and thereby solenoidal force is directly conveyed to the main valve element 18. Thus, the main valve can be immediately closed when the solenoid 3 is switched from on to off and thereby the starting current is supplied to the solenoid 3. Also, the main valve seat 22 is formed integrally with the sub-valve element 20, so that the sub-valve element 20 can also function as a movable valve seat. Thus, the sub-valve is opened simultaneously when the main valve is closed. This not only restricts the introduction of refrigerant into the crankcase but also allows discharging the refrigerant from the crankcase, so that the compressor can be promptly started.

Second Embodiment

Figure 5:
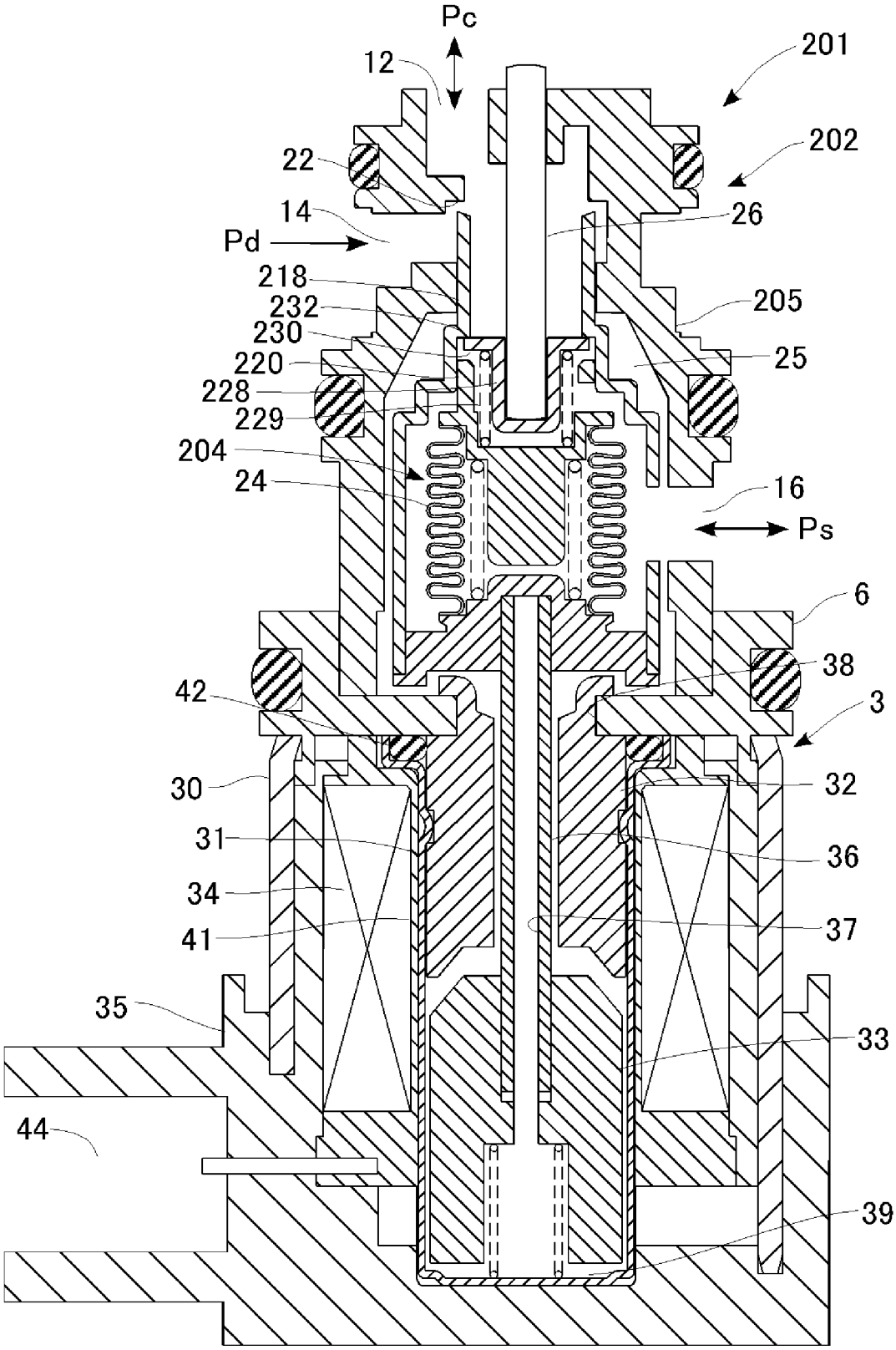
FIG. 5 is a cross-sectional view of a structure of a control valve according to a second embodiment of the present invention.
Figure 6:
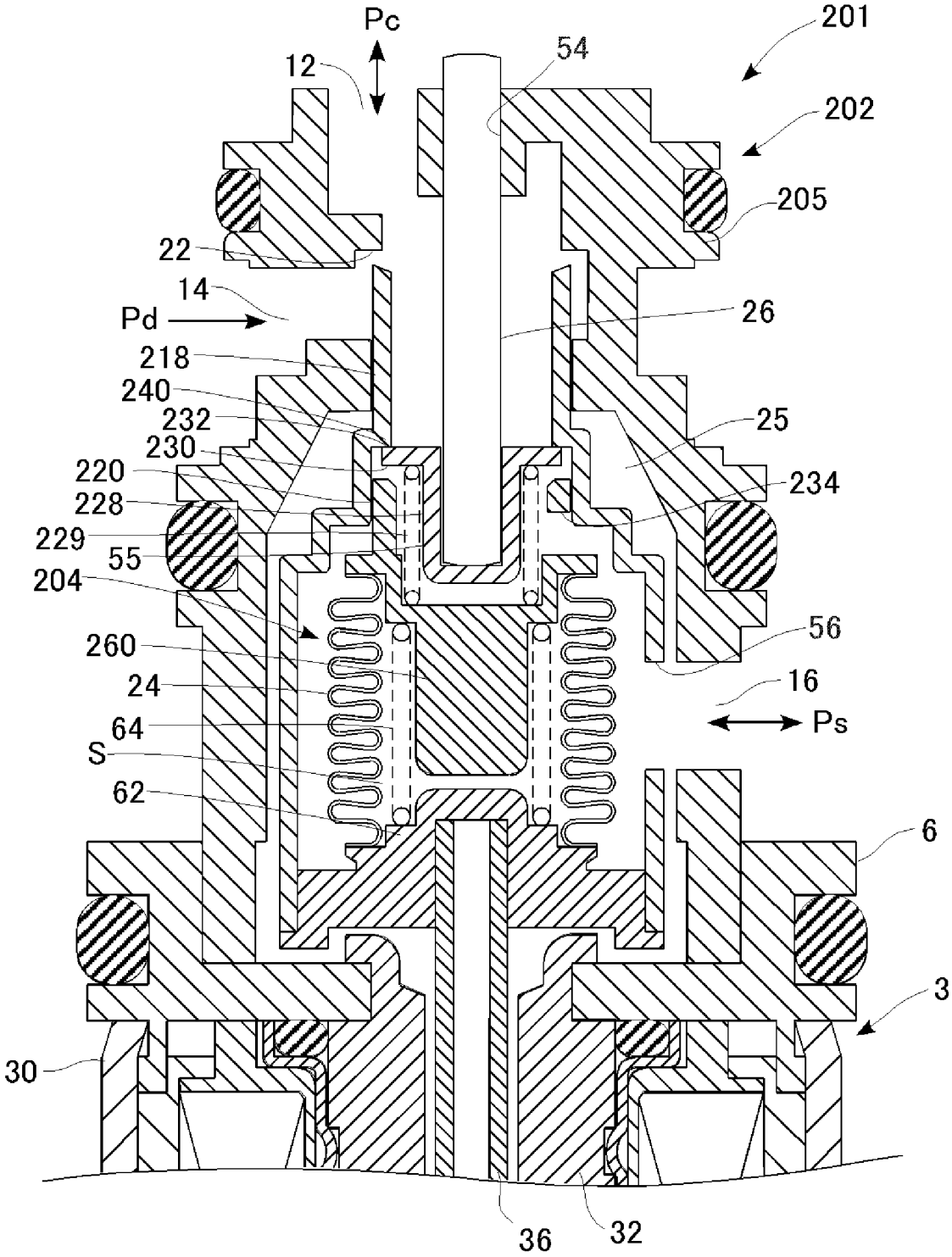
FIG. 6 is a partially enlarged sectional view of an upper half of FIG. 5.

A description is now given of a second embodiment of the present invention. A control valve according to the second embodiment shares many common features with the first embodiment except for the structure and arrangement of main valve and sub-valve. Thus, the structural components of the second embodiment similar to those of the first embodiment are given the identical reference numerals and the description thereof is omitted as appropriate. FIG. 5 is a cross-sectional view of the structure of the control valve according to the second embodiment. FIG. 6 is a partially enlarged sectional view of an upper half of FIG. 5.

As shown in FIG. 5, a control valve 201 is constituted by integrally assembling a valve unit 202 and a solenoid 3. In the control valve 201, a main valve seat 22 is formed in a body 205, which is a different feature from the first embodiment. Also, a first sub-valve seat 230 and a second sub-valve seat 232 are formed in a valve seat forming member 228, and a part of a power element 204 constitutes a sub-valve element 220. The first sub-valve is opened and closed with the sub-valve element 220 touching and leaving the first sub-valve seat 230. Set between a valve seat forming member 228 and the power element 4 is a spring 229 that biases the sub-valve element 220 in a valve opening direction. While a main valve element 218 opens and closes the main valve by touching and leaving the main valve seat 22, the main valve element 218 opens and closes the second sub-valve by touching and leaving the second sub-valve seat 232.

As shown in FIG. 6, the main valve element 218 is of a stepped cylindrical shape such that the diameter thereof contracts upward in a plurality of steps, and it functions as an open/close valve element 240 with one stepped portion of them touching and leaving the second sub-valve seat 232. The valve seat forming member 228 is such that the first sub-valve seat 230 is formed on an underside of an upper-end outer periphery of the valve seat forming member 228 and such that the second sub-valve seat 232 is formed on an upper side of the valve seat forming member 228. The sub-valve element 220 is formed connectedly on an upper end of a first stopper 260 constituting the power element 204. The sub-valve element 220, which is of a cylindrical shape, touches and leaves the first sub-valve seat 230 on the upper surface of the sub-valve element 220. A communicating hole 234 communicating the inside and the outside of the sub-valve element 220 is provided in a side wall of the sub-valve element 220. Set between the valve seat forming member 228 and the first stopper 260 is the spring 229.

Figure 7:
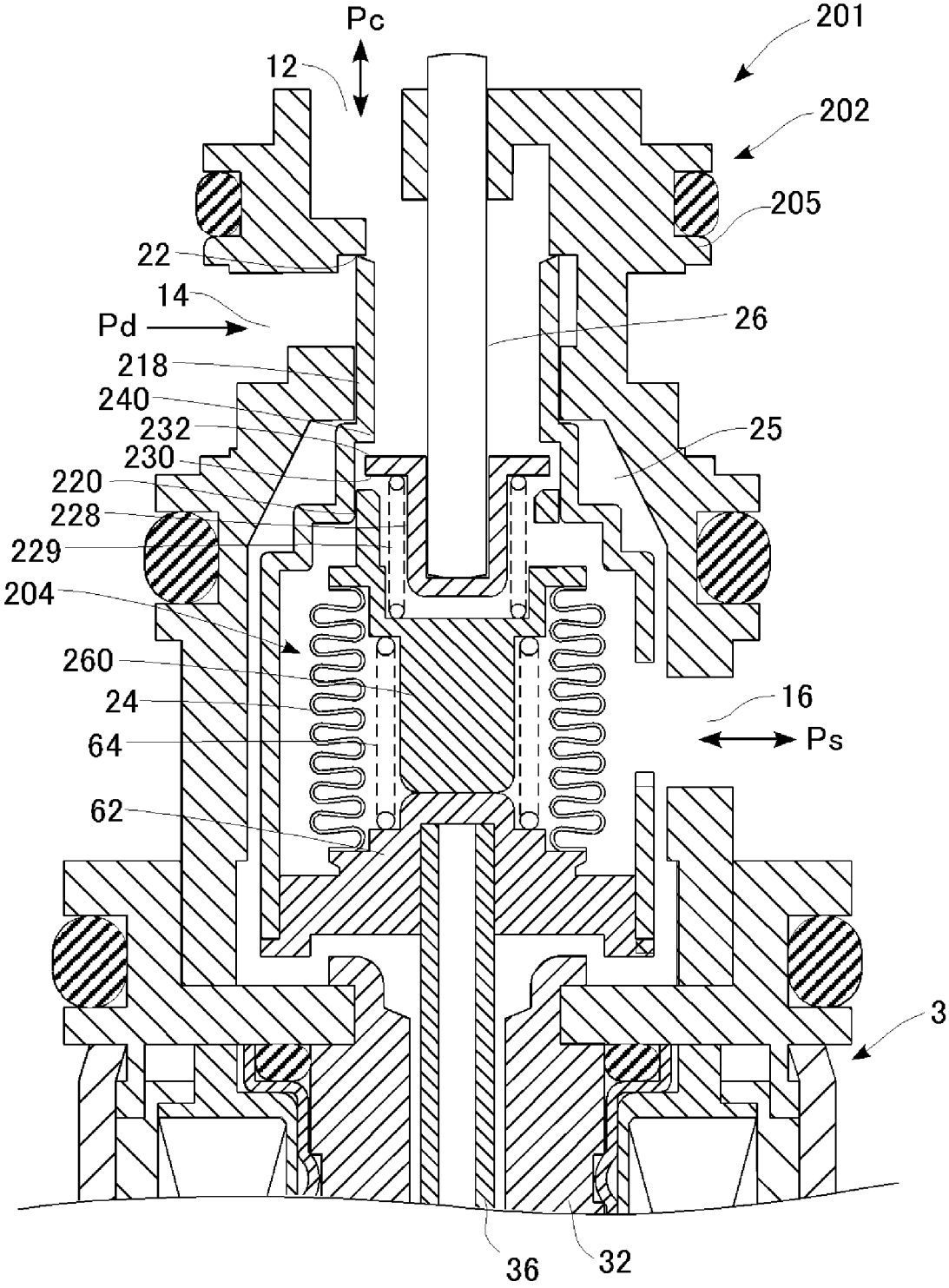
FIG. 7 is a diagram to explain an operation of a control valve.
Figure 8:
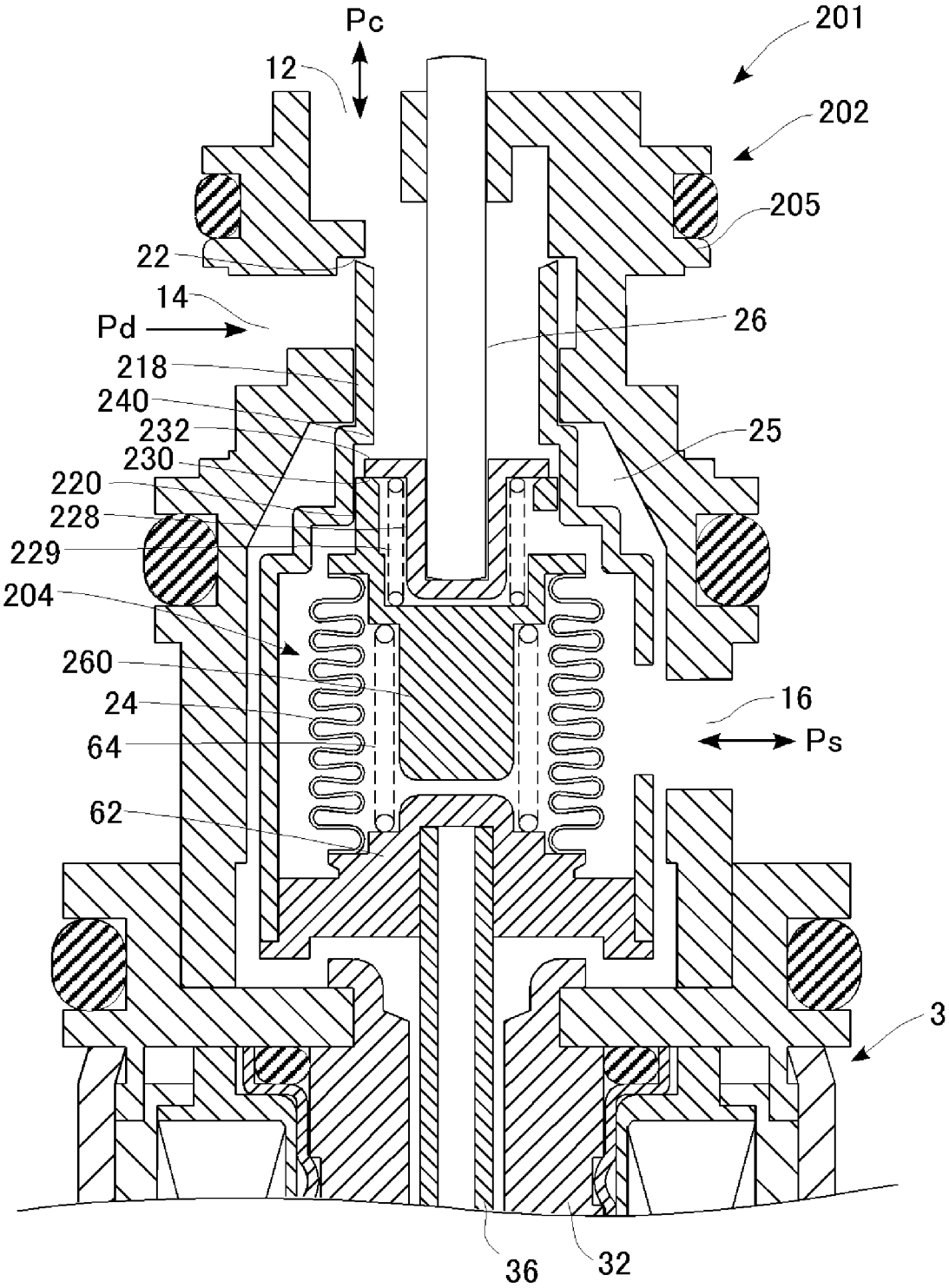
FIG. 8 is a diagram to explain an operation of a control valve.

Now, an operation of the control valve will be explained. FIG. 7 and FIG. 8 are each a diagram to explain an operation of the control valve, and FIG. 7 and FIG. 8 correspond to FIG. 6. FIG. 6, already described above, shows a state where the control valve operates with the minimum capacity. FIG. 7 shows a state where a bleed function is performed. FIG. 8 shows a relatively stable control state. A description is given hereinbelow based on FIG. 5 with reference to FIG. 6 to FIG. 8, as appropriate.

While the solenoid 3 is not electrically conducting, no solenoidal force works in the control valve 201. Thus, as shown in FIG. 6, the power element 204 is displaced downward under the effect of the biasing force of the spring 229. And the main valve element 218 is apart from the main valve seat 22 and therefore the main valve is fully opened. Since, at this time, the open/close valve element 240 touches the second sub-valve seat 232, the second sub-valve is closed. At this time, the refrigerant, having the discharge pressure of Pd, which is introduced from the discharge chamber of the compressor to the port 14 passes through the fully opened main valve and flows into the crankcase from the port 12. Thus, the crank pressure Pc rises and then the compressor performs the minimum capacity operation.

On the other hand, when a maximum control current is supplied to the coil 34 of the solenoid 3 at the startup or the like of the automotive air conditioner, the solenoidal force is directly transmitted to the main valve element 218 by way of the transmitting rod 36 and the second stopper 62, as shown in FIG. 7. As a result, the main valve element 218 touches the main valve seat 22 so as to close the main valve and, at the same time, the open/close valve element 240 gets separated apart from the second sub-valve seat 232 so as to open the second sub-valve. On the other hand, since the suction pressure Ps is relatively high at the startup, the sub-valve element 220 also gets separated apart from the first sub-valve seat 230 so as to maintain the state where the first sub-valve is being opened. In other words, supplying the starting current to the solenoid 3 causes the main valve to be closed and thereby restricts the introduction of discharged refrigerant into the crankcase. At the same time, supplying the starting current thereto immediately opens the sub-valve so as to promptly relieve the refrigerant in the crankcase into the suction chamber. As a result thereof, the compressor can be quickly started.

Then, in the controlled state where the value of current supplied to the solenoid 3 is set to a predetermined value, the suction pressure Ps is relatively low. Thus, the bellows 24 expands with the sub-valve element 220 seated on the first sub-valve seat 230 and thereby the sub-valve being closed, as shown in FIG. 8. On the other hand, with the first sub-valve being thus closed, the main valve is independently opened and closed, and the control valve operates in such a manner that the suction pressure Ps is kept at the pressure setting Pset.

Third Embodiment

Figure 9:
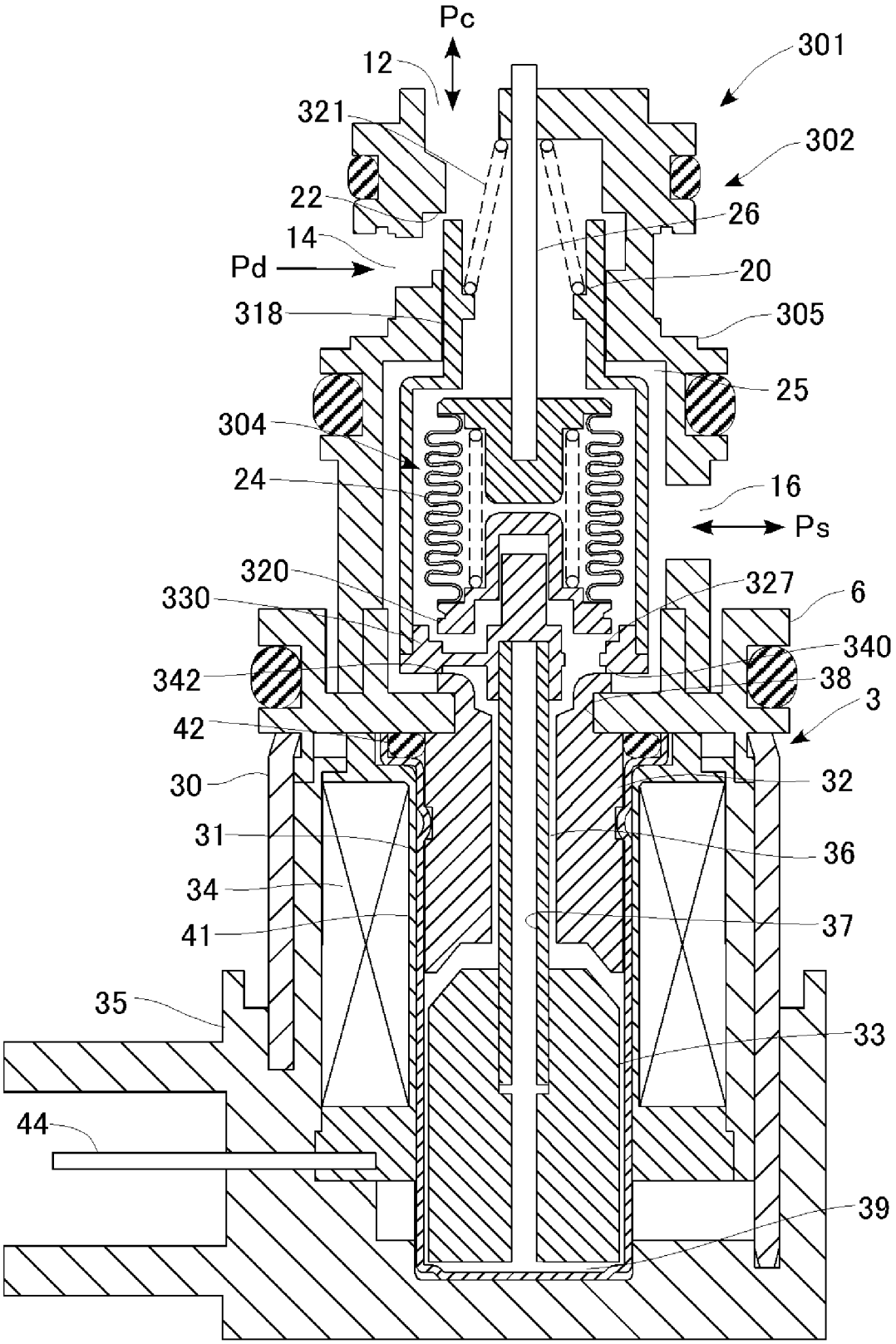
FIG. 9 is a cross-sectional view of a structure of a control valve according to a third embodiment of the present invention.
Figure 10:
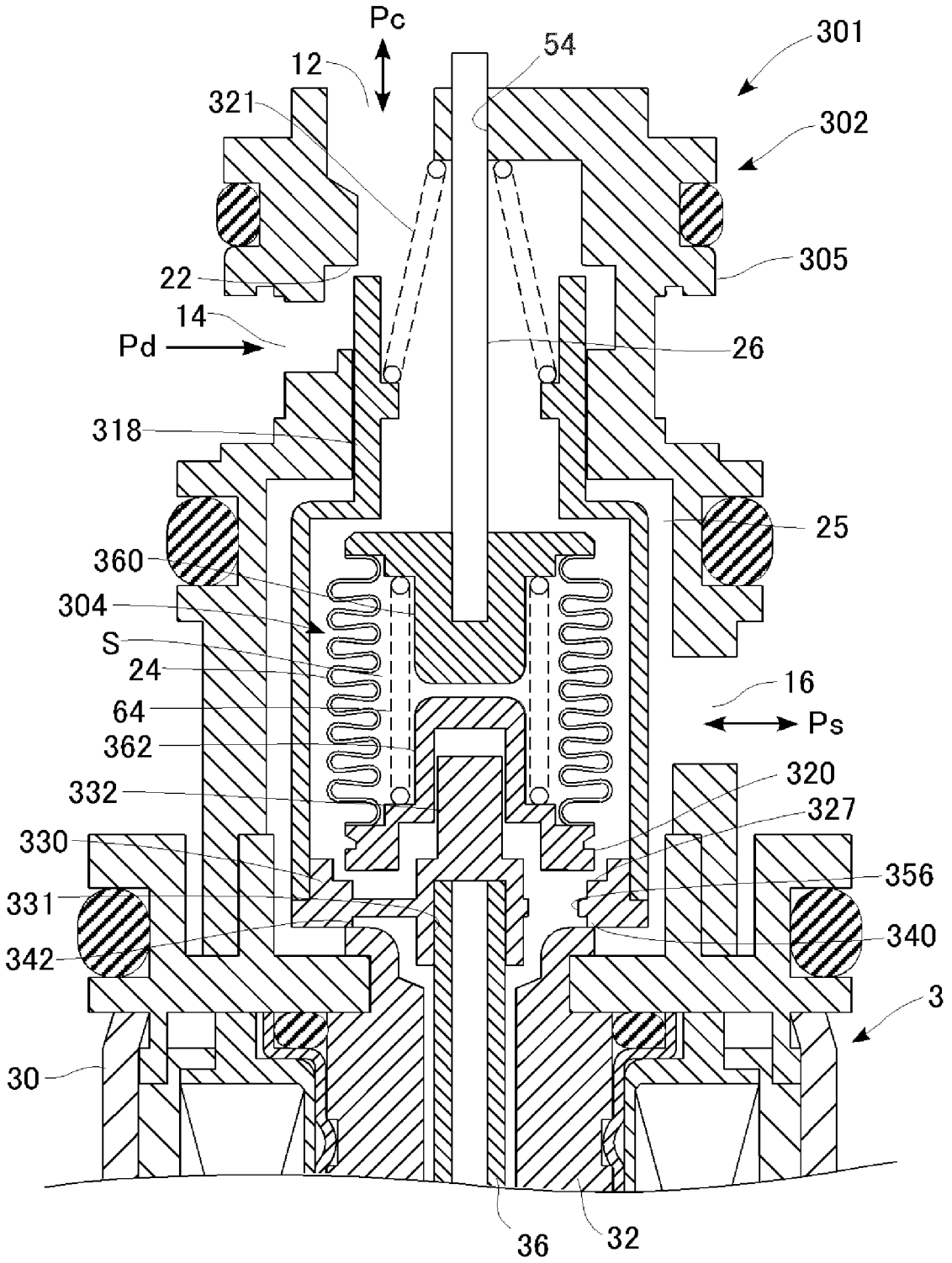
FIG. 10 is a partially enlarged sectional view of an upper half of FIG. 9.

A description is now given of a third embodiment of the present invention. A control valve according to the third embodiment shares many common features with the first embodiment except for the structure and arrangement of main valve and sub-valve. Thus, the structural components of the third embodiment similar to those of the first embodiment are given the identical reference numerals and the description thereof is omitted as appropriate. FIG. 9 is a cross-sectional view of the structure of the control valve according to the third embodiment. FIG. 10 is a partially enlarged sectional view of an upper half of FIG. 9.

As shown in FIG. 9, a control valve 301 is constituted by integrally assembling a valve unit 302 and a solenoid 3. In the control valve 301, a main valve seat 22 is formed in a body 305, which is a different feature from the first embodiment. Also, a shaft 26 is fixed to a power element 304, and a main valve element 318 is fixed to a base member 330 that is a separate member from the power element 304. A first sub-valve seat 327 is formed in the base member 330. Set between the main valve element 318 and the body 305 is a spring 321 (functioning as a "biasing member") that biases the main valve element 318 in a valve opening direction.

As shown in FIG. 10, a first stopper 360 of the power element 304 is fixed to the shaft 26, and a second shaft thereof is supported by the base member 330. The base member 330 has a recess 331 that joins the transmitting rod 36 and a protrusion 332 that joins the second stopper 362. The second stopper 362 is slidably supported by the protrusion 332. A communicating hole 356 communicating the inside of the main valve element 318 and the pressure chamber 25 is provided in the base member 330, and the first sub-valve seat 327 is formed above the communicating hole 356. A sub-valve element 320 is formed integrally with the second stopper 362, and the sub-valve element 320 opens and closes the first sub-valve by touching and leaving the first sub-valve seat 327. Also, a second sub-valve seat 342 is formed on an upper end of a core 32, and an open/close valve element 340 is formed integrally with the base member 330. The second sub-valve is opened and closed with the open/close valve element 340 touching and leaving the second sub-valve seat 342.

Figure 11:
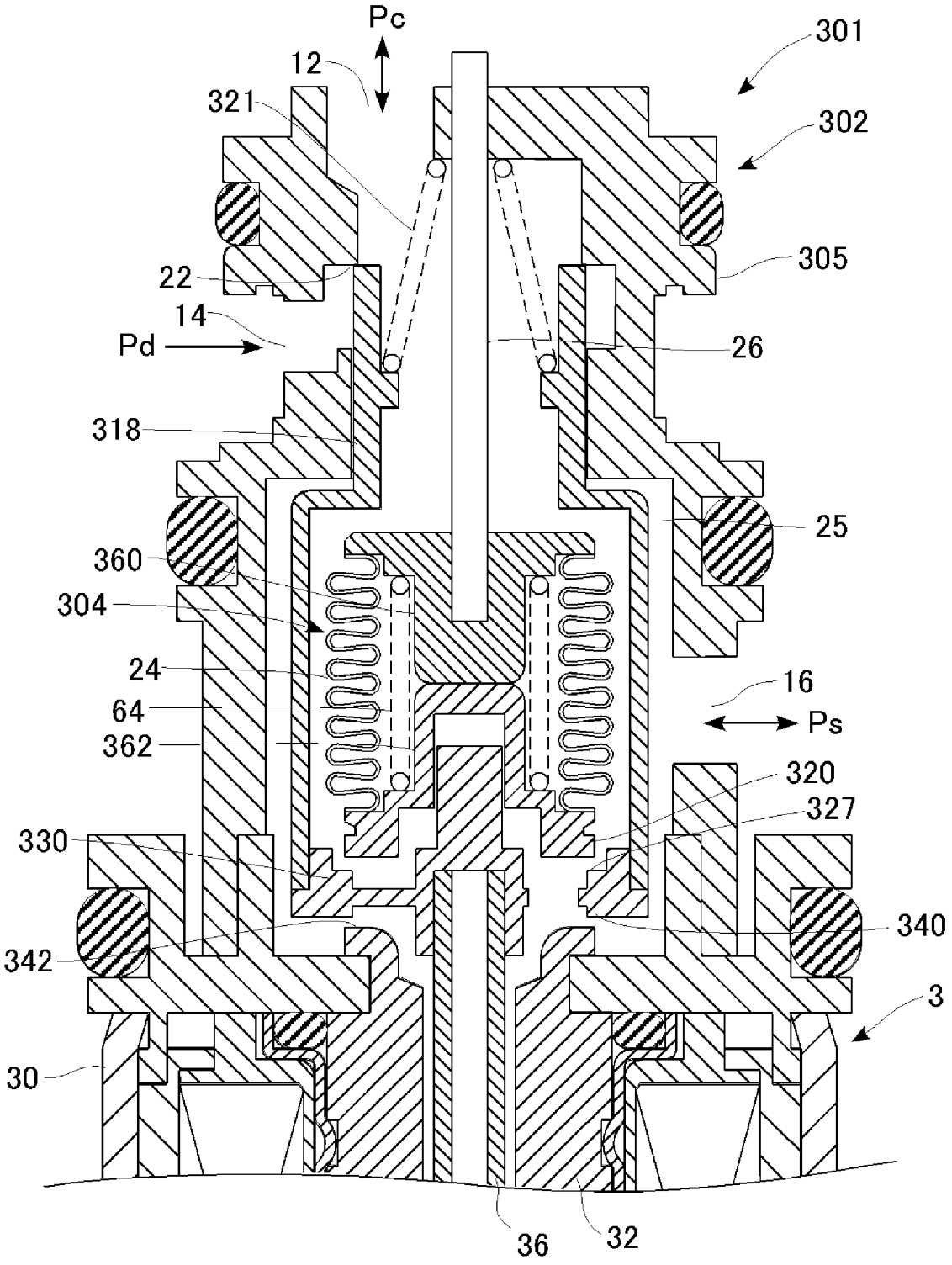
FIG. 11 is a diagram to explain an operation of a control valve.
Figure 12:
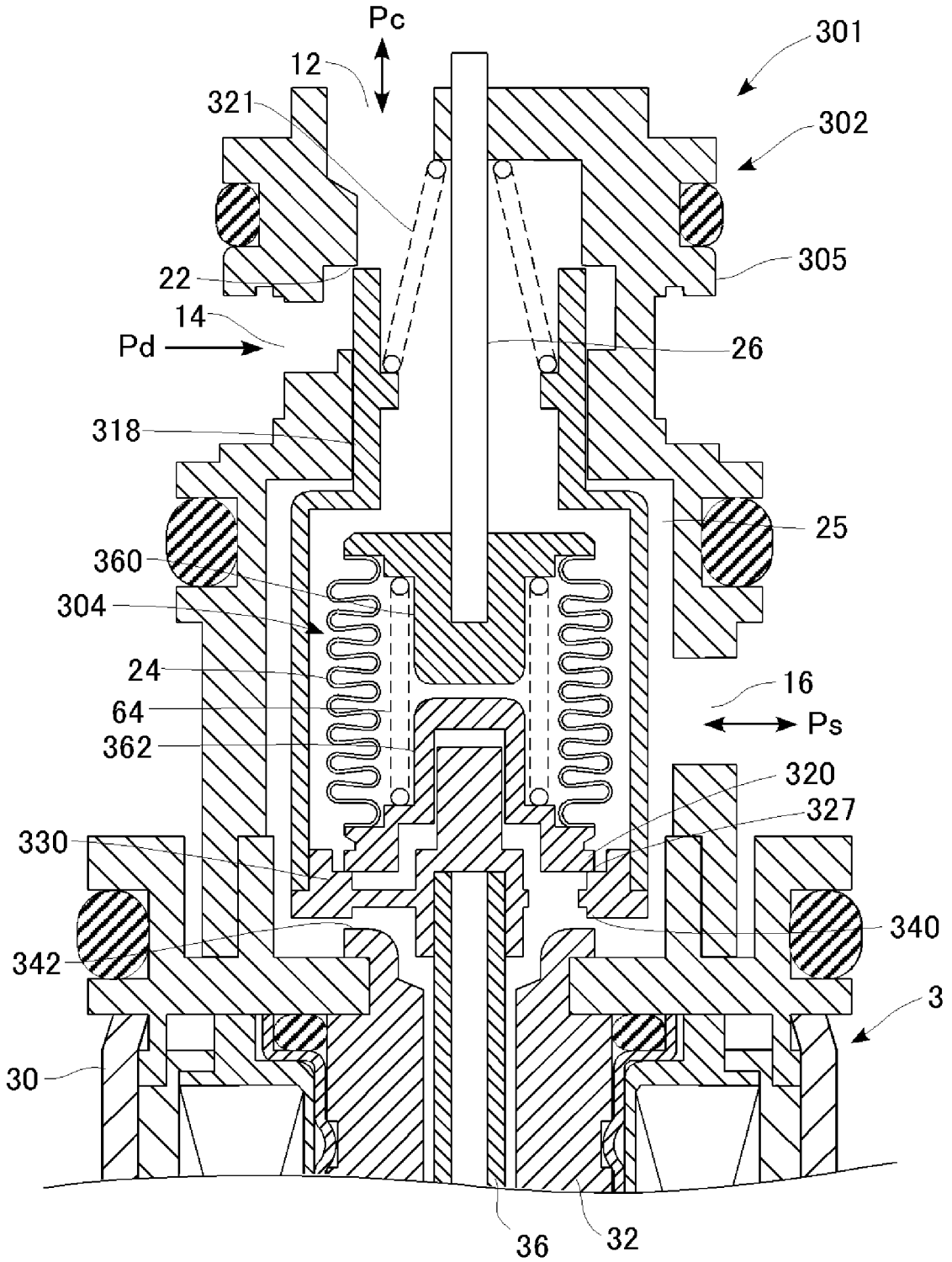
FIG. 12 is a diagram to explain an operation of a control valve.

Now, an operation of the control valve will be explained. FIG. 11 and FIG. 12 are each a diagram to explain an operation of the control valve, and FIG. 11 and FIG. 12 correspond to FIG. 10. FIG. 10, already described above, shows a state where the control valve operates with the minimum capacity. FIG. 11 shows a state where a bleed function is performed. FIG. 12 shows a relatively stable control state. A description is given hereinbelow based on FIG. 9 with reference to FIG. 10 to FIG. 12, as appropriate.

While the solenoid 3 is not electrically conducting, no solenoidal force works in the control valve 301. Thus, as shown in FIG. 10, the main valve element 318 gets separated away from the main valve seat 22 under the effect of the biasing force of the spring 321, and the main valve is fully opened. However, since the sub-valve element 320 gets separated away from the first sub-valve seat 327 so as to open the first sub-valve but the open/close valve element 340 is seated on the second sub-valve seat 342, the second sub-valve is closed. Accordingly, the first refrigerant passage is open but the second refrigerant passage is blocked. At this time, the refrigerant, having the discharge pressure of Pd, which is introduced from the discharge chamber of the compressor to the port 14 passes through the fully opened main valve and flows into the crankcase from the port 12. Thus, the crank pressure Pc rises and then the compressor performs the minimum capacity operation.

On the other hand, when a maximum control current is supplied to the coil 34 of the solenoid 3 at the startup or the like of the automotive air conditioner, the solenoidal force is directly transmitted to the main valve element 318 by way of the transmitting rod 36 and the base member 330, as shown in FIG. 11. As a result, the main valve element 318 touches the main valve seat 22 and, at the same time, the open/close valve element 340 gets separated apart from the second sub-valve seat 342 so as to close the second sub-valve. On the hand, since the suction pressure Ps is relatively high at the startup, the sub-valve element 320 gets separated apart from the first sub-valve seat 327 so as to open the first sub-valve. In other words, supplying the starting current to the solenoid 3 causes the main valve to be closed and thereby restricts the introduction of discharged refrigerant into the crankcase. At the same time, supplying the starting current thereto immediately opens the sub-valve so as to promptly relieve the refrigerant in the crankcase into the suction chamber. As a result thereof, the compressor can be quickly started.

Then, in the controlled state where the value of current supplied to the solenoid 3 is set to a predetermined value, the suction pressure Ps is relatively low. Thus, the bellows 24 expands with the sub-valve element 320 seated on the first sub-valve seat 327 and thereby the sub-valve being closed, as shown in FIG. 12. As a result, the second refrigerant passage is blocked. On the other hand, with the first sub-valve being thus closed, the main valve is independently opened and closed, and the main valve operates in such a manner that the suction pressure Ps is kept at the pressure setting Pset.

The description of the present invention given above is based upon illustrative embodiments. These embodiments are intended to be illustrative only and it will be obvious to those skilled in the art that various modifications could be further developed within the technical idea underlying the present invention and that such additional modifications are also within the scope of the present invention.

Figure 13:
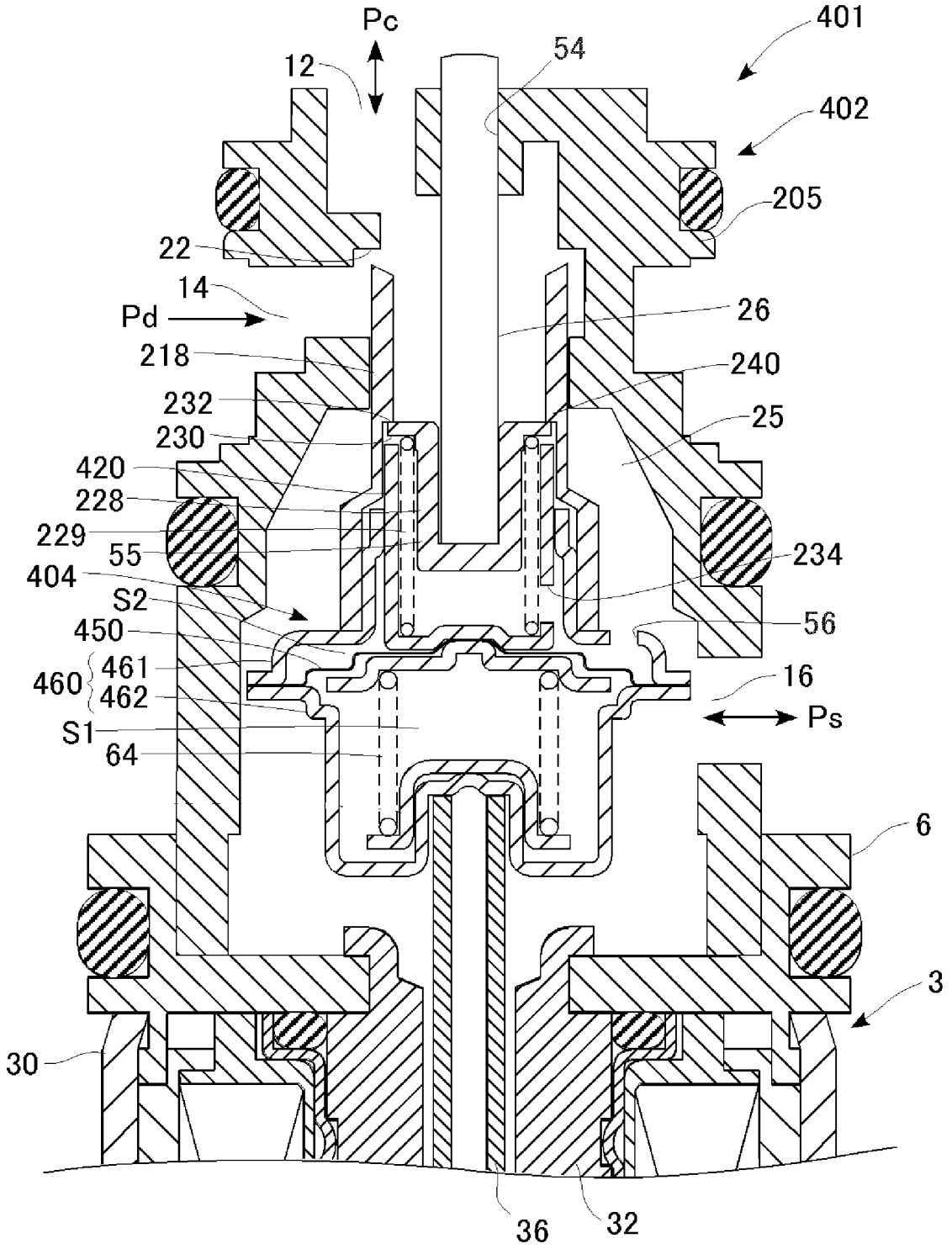
FIG. 13 is an enlarged view of an upper half of a control valve according to a modification.

In the above-described embodiments, the bellows is used, for example, as a pressure-sensing member of the power element but, for example, a diaphragm may be used instead. FIG. 13 is an enlarged view of an upper half of the control valve according to a modification, and FIG. 13 corresponds to the second embodiment of FIG. 6.

In other words, a control valve 401 according to the present modification is constituted by integrally assembling a valve unit 402 and a solenoid 3. A power element 404 of the control valve 401 includes (1) a hollowed housing 460, (2) a diaphragm 450 serving as a pressure-sensing member so disposed that the interior of the housing 460 is partitioned into an enclosed space S1 (which functions as "reference pressure chamber") and an open space S2, and (3) a spring 64 disposed in the enclosed space S1.

The housing 460 is formed such that a first housing 461 and a second housing 462 are joined together. The housing 460 is formed in the shape of a vessel or the like such that while the diaphragm 450 is held between the first housing 461 and the second housing 462, the outer periphery of the first housing 461 and the second housing 462 is welded along its joint part thereof. Since the welding is performed in a vacuum atmosphere, the enclosed space S1 is in a vacuum state. However, the enclosed space S1 may be filled with air, instead.

A sub-valve element 420 is joined to a top surface of the first housing 461. A communicating hole 234 communicating the inside and the outside of a sub-valve element 420 is provided in a side wall of the sub-valve element 420. The first housing 461 is of a stepped cylindrical shape such that the diameter thereof contracts upward, and a side wall of the sub-valve element 420 is supported by the first housing 461 on the upper end thereof. The main valve element 218 is fixed to the first housing 461 in a fitted manner. Provided in the first housing 461 is a communicating hole 56 communicating the inside and the outside of the first housing 461. The second housing 462, which is of a bottomed cylindrical shape, is joined with the first housing 461 on an upper end of the second housing 462. A disk is each placed in the diaphragm 450 on a surface thereof at a second housing 462 side and on the bottom of the second housing 462, and a spring 64 used to adjust the load setting is set between these disks.

In this modification, if the suction pressure Ps in the pressure chamber 25 drops lower than a predetermined pressure setting Pset, the diaphragm 450 will expand in such a manner as to enlarge the enclosed space S1 and drive the sub-valve element 420 in a valve closing direction. This pressure setting Pset is adjusted in advance by the spring load of the spring 64. And this pressure setting Pset is set as a pressure value at which the freezing of the evaporator can be prevented in view of the relationship between the temperature in the evaporator and the suction pressure Ps. The spring load of the spring 64 can be adjusted using a press-fitting amount of the shaft 26. Note that the operation performed by the control valve 401 is similar to that described in the second embodiment and therefore the description thereof is omitted here.

In this modification, a description has been given of an example where the bellows used in the second embodiment is replaced by the diaphragm. However, this should not be considered as limiting and, for example, the bellows may be replaced by a diaphragm or the like in the first and the third embodiment.

What is claimed is:

1. A control valve for a variable displacement compressor for varying a discharging capacity of the variable displacement compressor by controlling a flow rate of refrigerant to be introduced from a discharge chamber to a crankcase of the compressor in such a manner that a suction pressure of a suction chamber is kept at a pressure setting, the control valve comprising:

a body having a crankcase communicating port that communicates with the crankcase, a discharge chamber communicating port that communicates with the discharge chamber, and a suction chamber communicating port that communicates with the suction chamber, wherein the crankcase communicating port, the discharge chamber communicating port, and the suction chamber communicating port are arranged in this order from one end side of the body;

a main valve element configured to open and close a main valve provided in a refrigerant passage communicating between the discharge chamber communicating port and the crankcase communicating port;

a solenoid, provided at the other end side of the body, configured to drive the main valve element in a valve closing direction in accordance with an amount of current supplied;

a pressure-sensing section including a pressure-sensing member displaced by sensing the suction pressure, wherein the pressure sensing section is provided inside an inner space surrounded by the body and the solenoid, and the pressure sensing section exerts a drive force against a solenoidal force caused by a displacement of the pressure-sensing member; and a shaft configured to adjust the drive force of the pressure-sensing section by adjusting a fixed position at one end of the shaft, the shaft extending from one end to the other end thereof along an axis line, one end of the shaft being fixed to the one end side of the body and the other end of the shaft being joined with the pressure-sensing section, wherein the shaft and the main valve element are separate elements and are relatively displaceable to each other.

2. A control valve, for a variable displacement compressor, according to claim 1, the pressure-sensing section including:

a base member displaceably supported in a direction of the axis line such that the base member is set between a transmitting rod, which extends from the solenoid and transmits the solenoidal force, and the shaft; and the pressure-sensing member configured to be deformed in the direction of the axis line in accordance with the suction pressure, the pressure-sensing member and the base member forming an airtight reference pressure chamber inside the pressure-sensing section, wherein the main valve element is displaceable integrally with the transmitting rod.

3. A control valve for a variable displacement compressor for varying a discharging capacity of the variable displacement compressor by controlling a flow rate of refrigerant to be introduced from a discharge chamber to a crankcase of the compressor in such a manner that a suction pressure of a suction chamber is kept at a pressure setting, the control valve comprising:

a body having a crankcase communicating port that communicates with the crankcase, a discharge chamber communicating port that communicates with the discharge chamber, and a suction chamber communicating port that communicates with the suction chamber, wherein the crankcase communicating port, the discharge chamber communicating port, and the suction chamber communicating port are arranged in this order from one end side of the body;

a main valve element configured to open and close a main valve provided in a refrigerant passage communicating between the discharge chamber communicating port and the crankcase communicating port;

a solenoid, provided at the other end side of the body, configured to drive the main valve element in a valve closing direction in accordance with an amount of current supplied;

a pressure-sensing section including a pressure-sensing member displaced by sensing the suction pressure, wherein the pressure sensing section is provided inside an inner space surrounded by the body and the solenoid, and the pressure sensing section exerts a drive force against a solenoidal force caused by a displacement of the pressure-sensing member; and a shaft configured to adjust the drive force of the pressure-sensing section by adjusting a fixed position at one end of the shaft, the shaft extending from one end to the other end thereof along an axis line, one end of the shaft being fixed to the one end side of the body and the other end of the shaft being joined with the pressure-sensing section, a sub-valve element configured to open and close a sub-valve provided in the refrigerant passage communicating between the crankcase chamber communicating port and the suction chamber communicating port, wherein the pressure sensing section exerts the drive force, by the displacement of the pressure-sensing member, to the sub-valve element.

4. A control valve, for a variable displacement compressor, according to claim 3, further comprising:

a valve seat forming member supported by the other end of the shaft;

a first biasing member configured to bias the pressure-sensing section in a valve opening direction of the main valve, the first biasing member being set between a base member of the pressure-sensing section and the valve seat forming member;

the sub-valve element, having a cylindrical body part disposed inside the body in such a manner as to insert the shaft therewithin, wherein an opening at one end side of the body part communicates with the crankcase communicating port, wherein a communicating hole that communicates between the discharge chamber communicating port and an inside passage is provided in a side wall of the body part, and wherein an opening at the other end of the body part touches and leaves the valve seat forming member so as to open and close the sub-valve; and a second biasing member configured to bias the sub-valve element in a valve closing direction of the sub-valve, wherein the main valve element touches and leaves the sub-valve element in a region outside the communicating hole so as to transmit a force in a valve opening direction of the sub-valve to the sub-valve element when the main valve is closed.

5. A control valve, for a variable displacement compressor, according to claim 3, further comprising:

a valve seat forming member supported by the other end of the shaft; and a biasing member configured to bias the pressure-sensing section in a valve opening direction of the main valve, the biasing member being set between a base member of the pressure-sensing section and valve seat forming member, wherein the main valve element has a cylindrical body part disposed inside the body in such a manner as to insert the shaft therewithin, an opening at one end side of the body part communicates with the crankcase communicating port, an opening at the other end of the body part communicates with the suction chamber communicating port, and the main valve is opened and closed in such a manner that the main valve element touches and leaves the main valve seat provided in the body, and wherein the sub-valve element is joined with one end of the pressure-sensing member and inserted within the main valve element, and the sub-valve is opened and closed in such a manner that the sub-valve element touches and leaves the valve seat forming member.

6. A control valve, for a variable displacement compressor, according to claim 3, the pressure-sensing section including:

a first base member supported by the shaft;

a second base member supported by a transmitting rod;

a bellows one end of which is fixed to the first base member and the other end of which is fixed to the second base member;

a spring, provided inward the bellows, which biases the first base member and the second base member in a spacing direction.

7. A control valve, for a variable displacement compressor, according to claim 4, the pressure-sensing section including:

a first base member supported by the shaft;

a second base member supported by a transmitting rod;

a bellows one end of which is fixed to the first base member and the other end of which is fixed to the second base member;

a spring, provided inward the bellows, which biases the first base member and the second base member in a spacing direction.

8. A control valve, for variable displacement compressor, according to claim 5, the pressure-sensing section including:

a first base member supported by the shaft;

a second base member supported by a transmitting rod;

a bellows one end of which is fixed to the first base member and the other end of which is fixed to the second base member;

a spring, provided inward the bellows, which biases the first base member and the second base member in a spacing direction.

9. A control valve, for a variable displacement compressor, according to claim 6, wherein the sub-valve element is provided integrally in the second base member, and wherein the sub-valve element touches and leaves an end side opening of the main valve element so as to open and close the sub-valve.

* * * * *